US007841497B1

(12) United States Patent
Gregory et al.

(10) Patent No.: US 7,841,497 B1
(45) **Date of Patent: *Nov. 30, 2010**

(54) HOLSTER RETENTION SYSTEM

(75) Inventors: Thomas M. Gregory, Belgrade, MT (US); Robert A. Kincaid, Bozeman, MT (US); Clifton L. Cook, Boise, ID (US); Eric M. Yeates, Virginia Beach, VA (US)

(73) Assignee: Blackhawk Industries Product Group Unlimited LLC, Norfolk, VA (US)

( * ) Notice: Subject to any disclaimer, the term of this patent is extended or adjusted under 35 U.S.C. 154(b) by 1073 days.

This patent is subject to a terminal disclaimer.

(21) Appl. No.: 11/030,270

(22) Filed: Jan. 6, 2005

(51) Int. Cl.
*F41C 33/02* (2006.01)

(52) U.S. Cl. ..... 224/243; 224/912

(58) Field of Classification Search ..... 224/244, 224/193, 243, 911, 912
See application file for complete search history.

(56) References Cited

U.S. PATENT DOCUMENTS

| | | | | |
|---|---|---|---|---|
| 2,349,376 | A * | 5/1944 | Ray | 224/244 |
| 2,551,913 | A * | 5/1951 | Toby | 224/244 |
| 3,910,469 | A * | 10/1975 | Baldocchi | 224/244 |
| 4,318,503 | A | 3/1982 | Capano | |
| 5,100,036 | A * | 3/1992 | Rogers et al. | 224/244 |
| 5,419,474 | A | 5/1995 | Marx et al. | |
| 5,518,155 | A | 5/1996 | Gallagher | |
| 5,570,830 | A | 11/1996 | Nichols | |
| 5,573,157 | A | 11/1996 | Mauriello et al. | |
| 5,630,535 | A | 5/1997 | Valenti | |
| 5,810,221 | A | 9/1998 | Beletsky et al. | |
| 5,855,305 | A | 1/1999 | Nichols | |
| 5,918,784 | A * | 7/1999 | Serpa | 224/244 |
| 5,944,239 | A * | 8/1999 | Rogers et al. | 224/193 |
| 6,085,951 | A | 7/2000 | Beletsky et al. | |
| 6,112,962 | A | 9/2000 | Matthews | |
| 6,588,639 | B2 * | 7/2003 | Beletsky et al. | 224/672 |
| 6,732,891 | B2 * | 5/2004 | Locklear, III | 224/244 |
| 6,752,300 | B2 * | 6/2004 | Har-Shen | 224/244 |
| 6,769,582 | B1 * | 8/2004 | Beletsky et al. | 224/244 |
| D501,991 | S * | 2/2005 | Cook et al. | D3/222 |
| 6,854,626 | B2 * | 2/2005 | Liao | 224/244 |
| 2001/0048009 | A1 * | 12/2001 | Vor Keller et al. | 224/244 |
| 2002/0017541 | A1 | 2/2002 | French | |
| 2002/0134803 | A1 | 9/2002 | Lowe et al. | |
| 2002/0153396 | A1 | 10/2002 | French et al. | |
| 2005/0035163 | A1 | 2/2005 | French et al. | |
| 2005/0205624 | A1 * | 9/2005 | French et al. | 224/244 |
| 2005/0279788 | A1 * | 12/2005 | Lowe et al. | 224/244 |

* cited by examiner

*Primary Examiner*—Justin M Larson
(74) *Attorney, Agent, or Firm*—Bowman Green Hampton & Kelly, PLLC

(57) ABSTRACT

A holster for a handgun, the holster having an axis that separates a frame/slide portion of the holster from a trigger guard portion of the holster and a lever having a finger button end and an engagement end, wherein the engagement end of the lever includes a locking portion protruding from a second side of the engagement end, wherein the lever is pivotally attached to a side wall of the holster, along the axis, approximately between the finger button end and the engagement end, such that the finger button end extends into the frame/slide portion of the holster and the engagement end extends into the trigger guard portion of the holster, wherein the lever is pivotable between an engaged position and a disengaged position, and wherein, when the lever is in the engaged position, the locking portion protrudes into a holster cavity, via an opening in the side wall.

30 Claims, 8 Drawing Sheets

HOLSTER RETENTION SYSTEM

BACKGROUND OF THE INVENTION

1. Field of the Invention

This invention relates generally to handgun holsters. In particular, the present invention relates to a handgun holster having a retention system.

2. Description of Related Art

Many users of handguns, particularly military and law enforcement personnel, carry a handgun in a holster designed to protect the handgun and hold it securely. Holsters can be worn in a number of ways, such as on a belt at the waist, on the thigh, under an arm, or around an ankle.

Certain users of handguns must be able to quickly and easily remove the handgun from a holster regardless of the type of holster used. Additionally, these users need to be assured that, when not in use, the handgun will remain safely in the holster.

Some holsters rely solely on friction to secure the handgun in place. This combination might not be suitable for situations where the gun/holster is subject to a great deal of movement because such movement could cause the handgun to lose frictional engagement with the holster.

Certain other holsters include a variety of strap or flap arrangements that prevent the removal of the firearm from the holster while the strap or flap is in place. With designs that rely on this method to retain a handgun, a user must first unfasten and/or rotate the strap/flap before the firearm can be withdrawn. Then, to re-secure the handgun in the holster once the handgun has been re-holstered, the user must physically refasten and/or rotate the strap/flap before the firearm is securely retained within the holster. Some users might not prefer these designs because of the time required to release and/or re-secure the handgun.

SUMMARY OF THE INVENTION

The present invention relates generally to handgun holsters. In particular, the present invention relates to a holster for a weapon, such as, for example, a handgun, having a retention system for securing a handgun such that the handgun is retained or locked in the holster when the retention system is engaged, but may be easily removed from the holster by the wearer while removal by anyone other than the wearer is difficult.

In an illustrative, non-limiting embodiment of this invention, the handgun holster comprises a handgun holster having a retention system. The retention system comprises a lever having an engagement end and a finger button end, the engagement end includes a locking portion for engaging an interior portion of the trigger guard of the handgun in the holster and, thereby, retaining the handgun in the holster.

The construction of the holster prevents the locking portion from contacting the trigger of the handgun by limiting how far the handgun can be inserted into the holster. The construction of the holster further facilitates alignment of the trigger guard with the locking portion by limiting movement of the handgun with respect to the lever.

The lever is positioned on the holster such that, when a user depresses the appropriate portion of the lever, thereby releasing the handgun from the holster, and draws the handgun from the holster, the user's index finger is positioned to contact the frame of the handgun, above the trigger guard.

In an illustrative, non-limiting embodiment of this invention, a biasing element is optionally included. If included, the biasing element contacts a front portion of the handgun's trigger guard and is spring-biased when the handgun is retained, or locked, in the holster. The biasing element biases the handgun out of the holster and assists in maintaining contact between the locking portion and the trigger guard. Furthermore, the biasing element may assist in removal of the handgun from the holster when the locking portion is disengaged from the trigger guard.

Thus, the present invention automatically locks the handgun in place in the holster with a releasable mechanism that is easily operated by a wearer of the holster. However, the present mechanism is not easily accidentally disengaged or disengaged by anyone other than the wearer.

Accordingly, this invention provides a handgun holster, having a retention system.

This invention separately provides a safe and reliable quick-release handgun holster.

This invention separately provides a handgun holster having a retention system, which is capable of retaining a handgun securely in the holster while permitting a quick release of the handgun when the user requires.

This invention separately provides a handgun holster having a retention system, which is simple to operate.

This invention separately provides a handgun holster having a retention system, which automatically secures the handgun in the holster upon seating of the handgun in the holster, without requiring any additional operation by the user.

This invention separately provides a handgun holster and a retention system that assists the user in positioning his or her index finger along the frame of the handgun, outside of and not on the trigger guard, as the handgun is drawn from the holster.

This invention separately provides a handgun holster having an optional passive retention system, which can be tightened to provide increased frictional tension between a portion of the holster and the handgun trigger guard without increasing the frictional tension between a remaining portion of the holster and the handgun.

This invention separately provides a handgun holster, which is capable of being manufactured using injection molding production techniques.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

Figure 1:
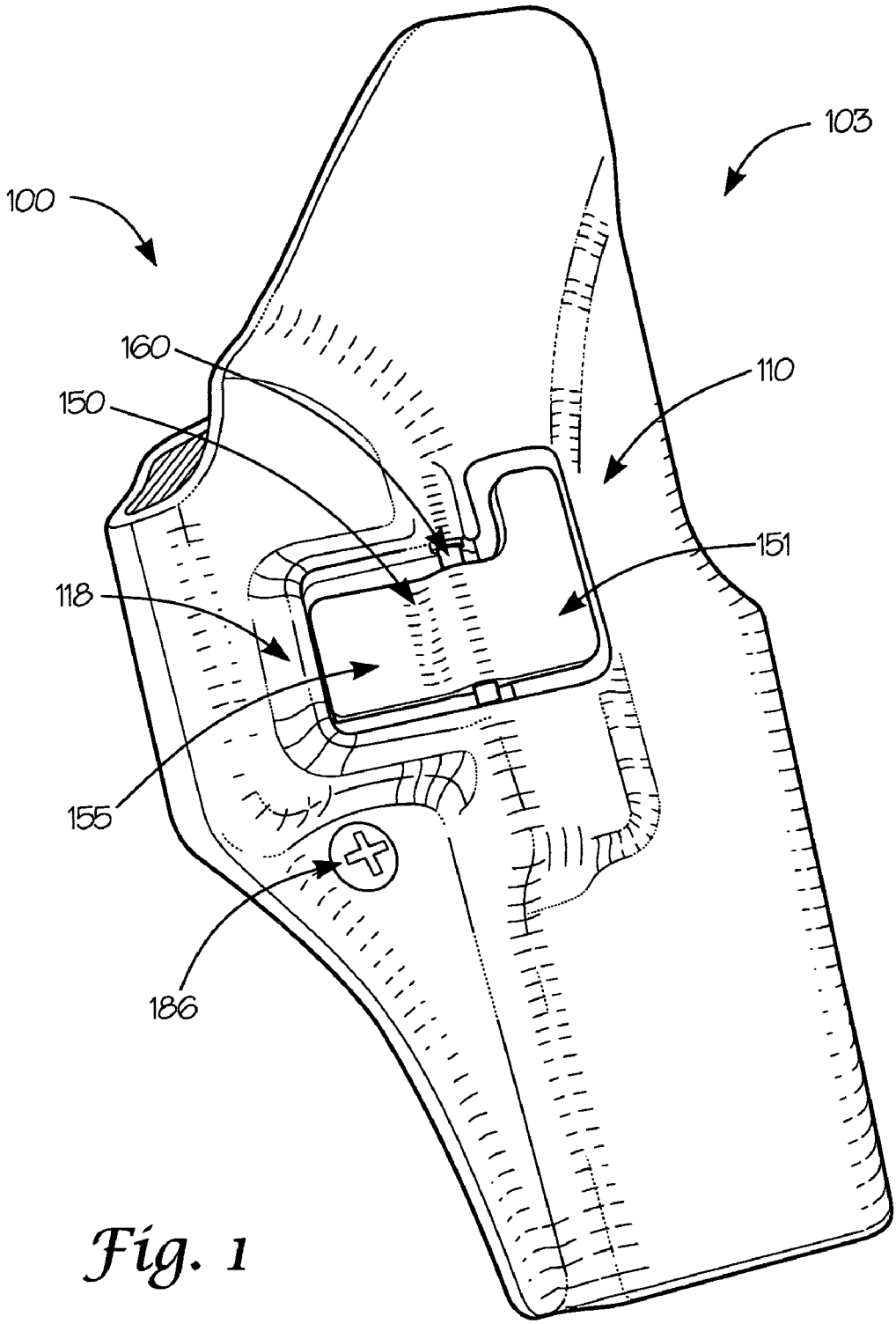
FIG. 1 shows a right perspective view of a first exemplary embodiment of a handgun holster having a retention system according to this invention.
Figure 2:
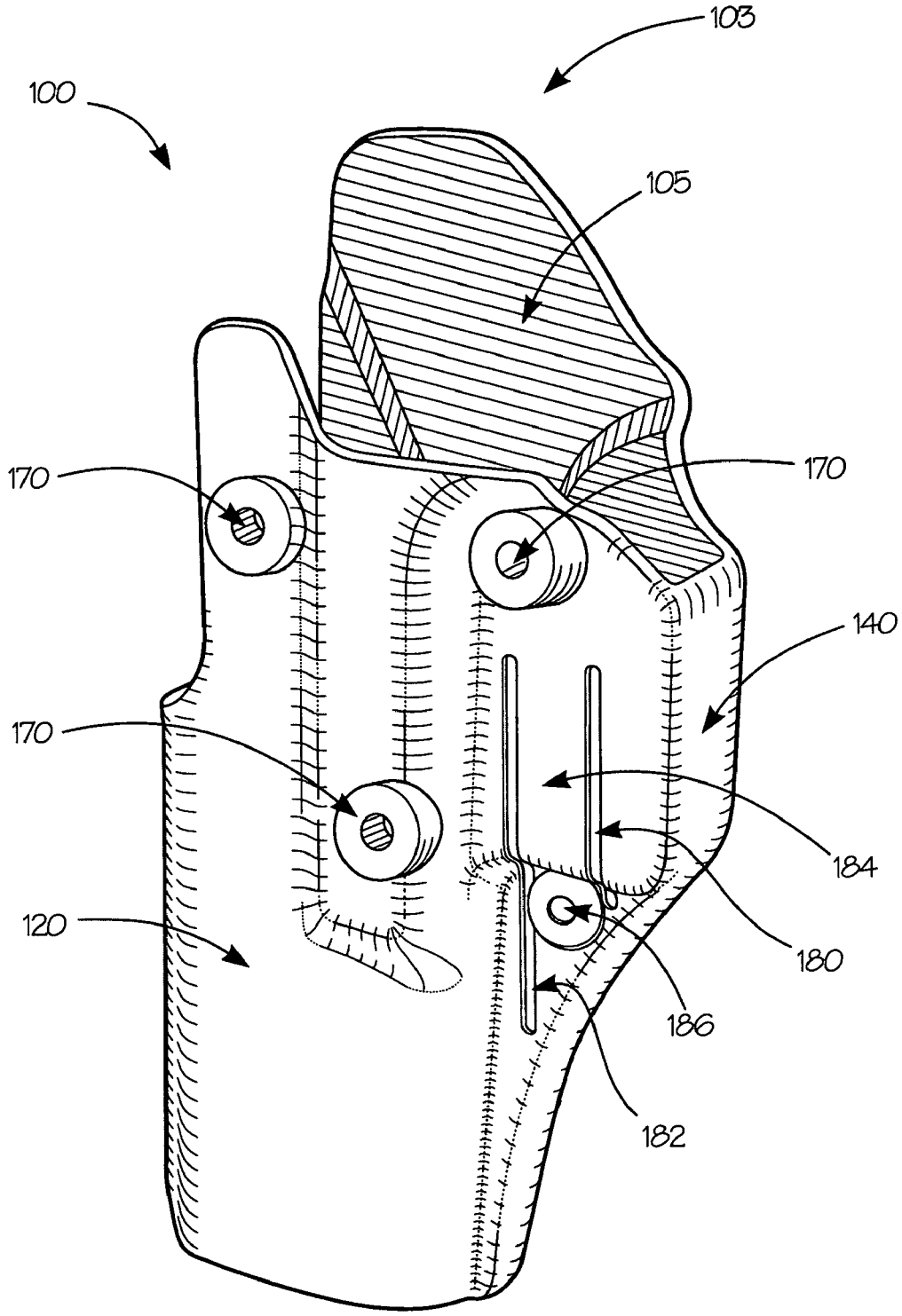
FIG. 2 shows a left perspective view of a first exemplary embodiment of a handgun holster having a retention system according to this invention.

For simplicity and clarification, the design factors and operating principles of the handgun holster according to this invention are explained with reference to various exemplary embodiments of a handgun holster according to this invention. The basic explanation of the design factors and operating principles of the handgun holster is applicable for the understanding, design, and operation of the handgun holster of this invention.

Furthermore, it should be appreciated that, for simplicity and clarification, the embodiments of this invention will be described with reference to a semiautomatic-type handgun being secured within the present holster. However, it should be appreciated that the operating principles of the handgun holster of this invention may also be employed to construct holsters or holders for any revolver or semiautomatic-type handgun, edged weapons as well as less than lethal products (i.e., tasers, pepper spray, mace canisters, or batons), so long as these items have an appropriate ledge or void that may be engaged or retained by a locking portion or other retaining means. Furthermore, it is also within the scope of the present invention that the present holster may be employed as a pouch for tactical accessories, such as ammunition magazines and/or flashlights, as well as for everyday items such as cell phones or personal digital assistants.

It should also be appreciated that the terms "handgun", "handgun holster", and "weapon" are used for basic explanation and understanding of the operation of the systems, methods, and apparatuses of this invention. Therefore, the terms "handgun", "handgun holster", and "weapon" are not to be construed as limiting the systems, methods, and apparatuses of this invention.

FIGS. 1-9B show various views of a first, illustrative, non-limiting embodiment of a handgun holster 100 having a retention system according to this invention. It should be appreciated that the holster 100 is adapted to retain a semiautomatic-type handgun. The semiautomatic-type handgun includes a slide, a grip, a trigger, and a trigger guard. The trigger guard includes an inner surface, which defines an area wherein the trigger is located and allows a user's finger access to the trigger, and an outer surface, which defines the outer perimeter of the trigger guard.

As shown in FIGS. 1-9B, the holster 100 includes a body 103 defining a cavity 105 for receiving and holding the handgun. The body 103 comprises a pair of opposed side walls comprising a first side wall 110 and a second side wall 120. Typically, the first side wall 110 is considered the outer side of the holster and is worn away from the user's body, while the second side wall 120 is considered the inner side of the holster and is worn against or adjacent the user's body.

In various exemplary embodiments, the body 103 further comprises at least some of a front wall 130 and a rear wall 140. However, it should be appreciated that the holster 100 may be formed such that one or more of the first side wall 110, the second side wall 120, the front wall 130, and/or the rear wall 140 is/are sufficient to define the cavity 105 for receiving the handgun and the remaining walls are not included.

The cavity 105 may be formed from any number or combination of walls, including, for example, a single, continuous wall or multiple coupled or joined walls. Thus, the cavity 105 may be formed by any cavity, space, or platform that is capable of retaining a handgun.

It should be noted that the walls of the holster 100 may generally be planar. Alternatively, the walls of the holster 100 may be contoured or shaped to better accommodate a specific type or model of handgun to be retained within the holster 100.

In various exemplary embodiments, the holster 100 is substantially rigid and is formed of a polymeric material such as a polymeric composite. Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, or the like, and/or various combinations of the foregoing.

Thus, it should be understood that the material or materials used to form the holster 100 and/or various components of the holster 100 is a design choice based on the desired appearance and functionality of the holster 100.

Figure 3:
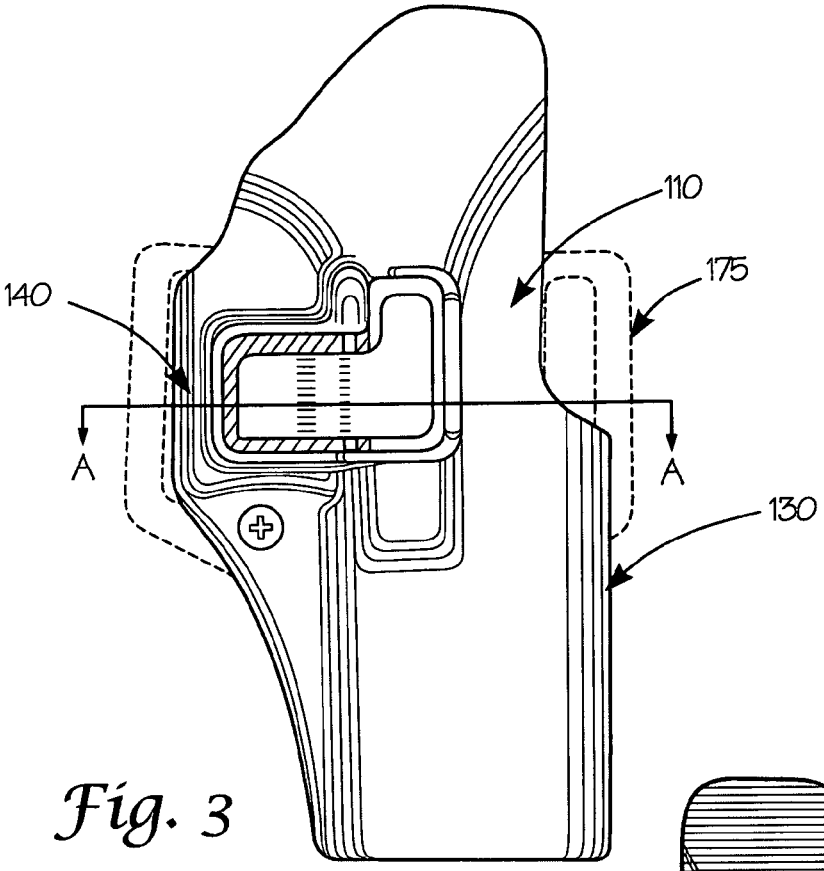
FIG. 3 shows a right side elevation view of a first exemplary embodiment of a handgun holster having a retention system according to this invention.
Figure 4:
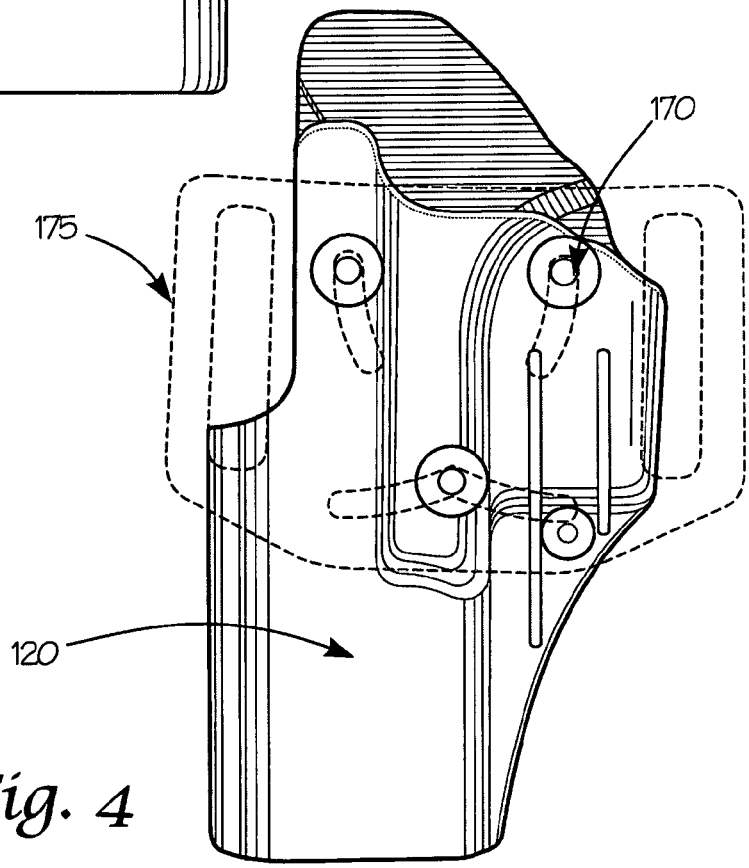
FIG. 4 shows a left side elevation view of a first exemplary embodiment of a handgun holster having a retention system according to this invention.
Figure 5:
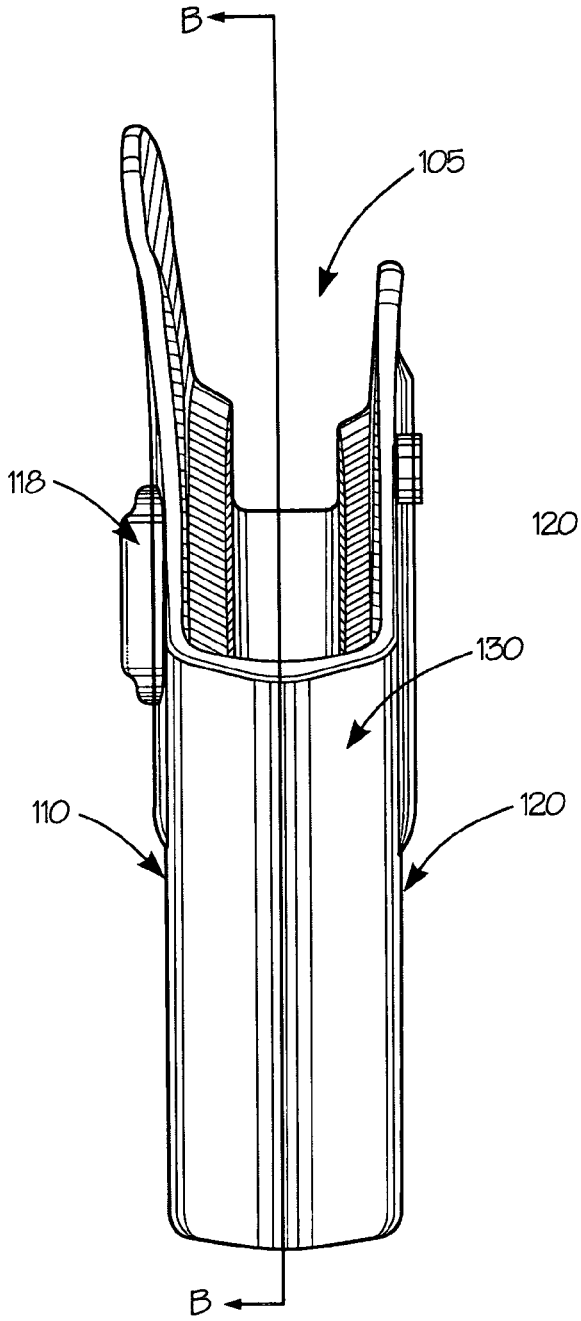
FIG. 5 shows a front elevation view of a first exemplary embodiment of a handgun holster having a retention system according to this invention.
Figure 6:
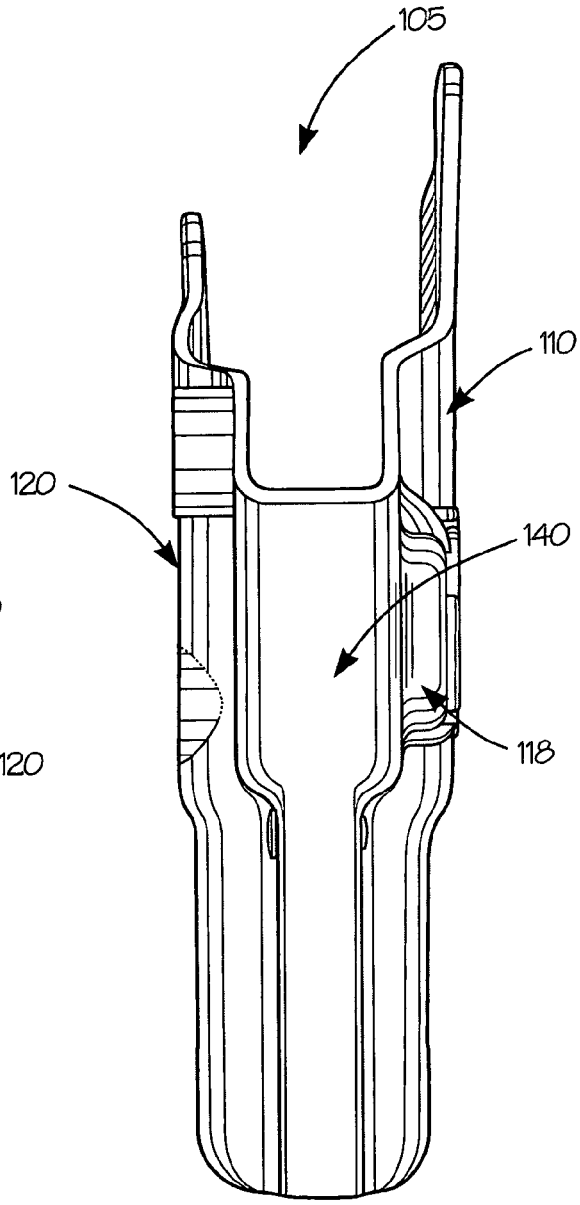
FIG. 6 shows a rear elevation view of a first exemplary embodiment of a handgun holster having a retention system according to this invention.
Figure 7:
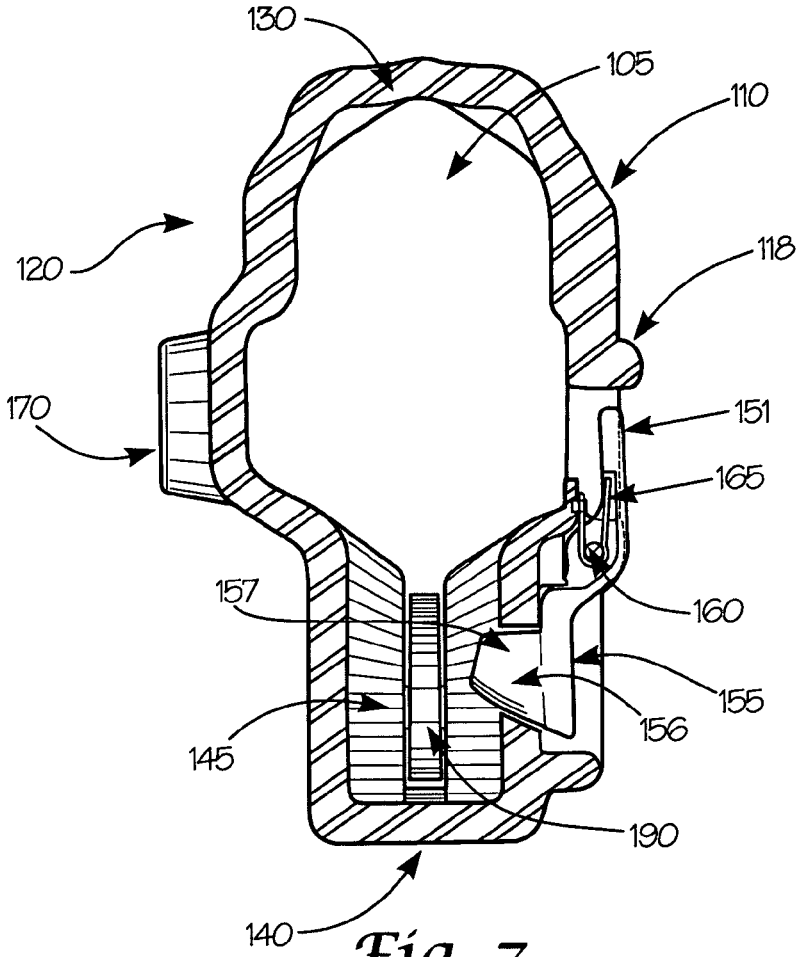
FIG. 7 shows a top cross-sectional view taken along line A-A of the handgun holster of FIG. 3, illustrating the first exemplary embodiment of the retention system according to this invention in greater detail.
Figure 8:
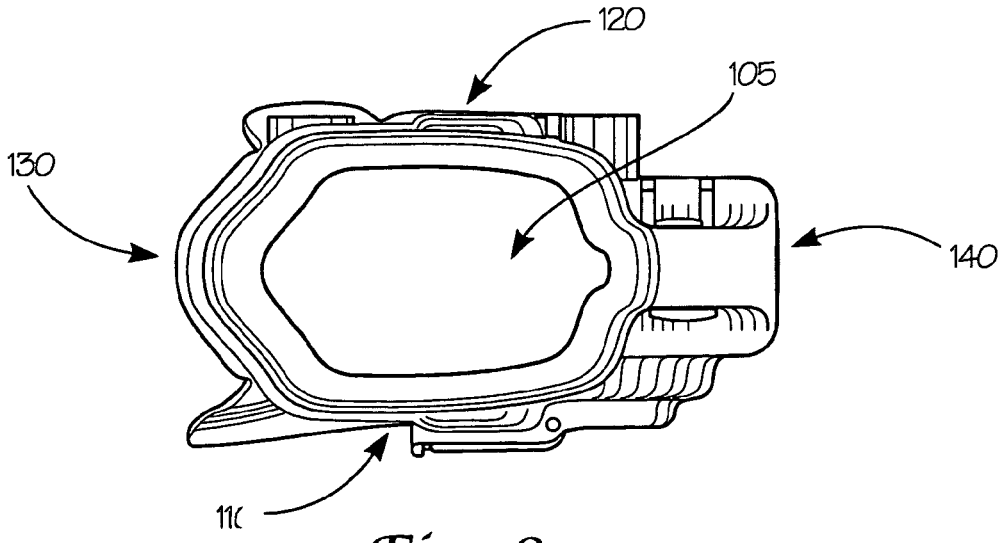
FIG. 8 shows a bottom plan view of a first exemplary embodiment of a handgun holster having a retention system according to this invention.
Figure 9A:
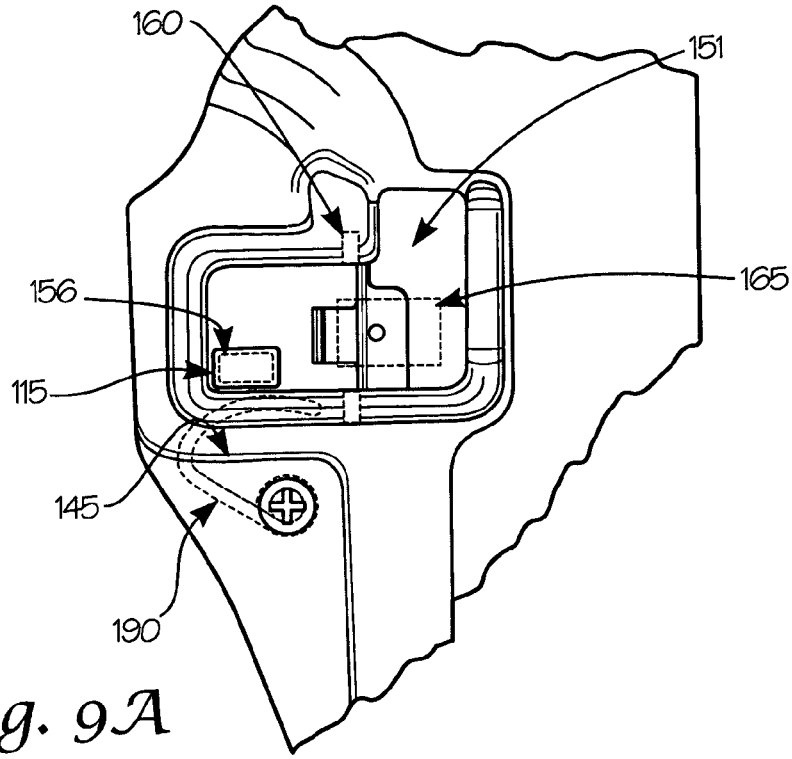
FIG. 9A shows a more detailed right side view of the handgun holster further illustrating the retention system according to this invention.
Figure 9B:
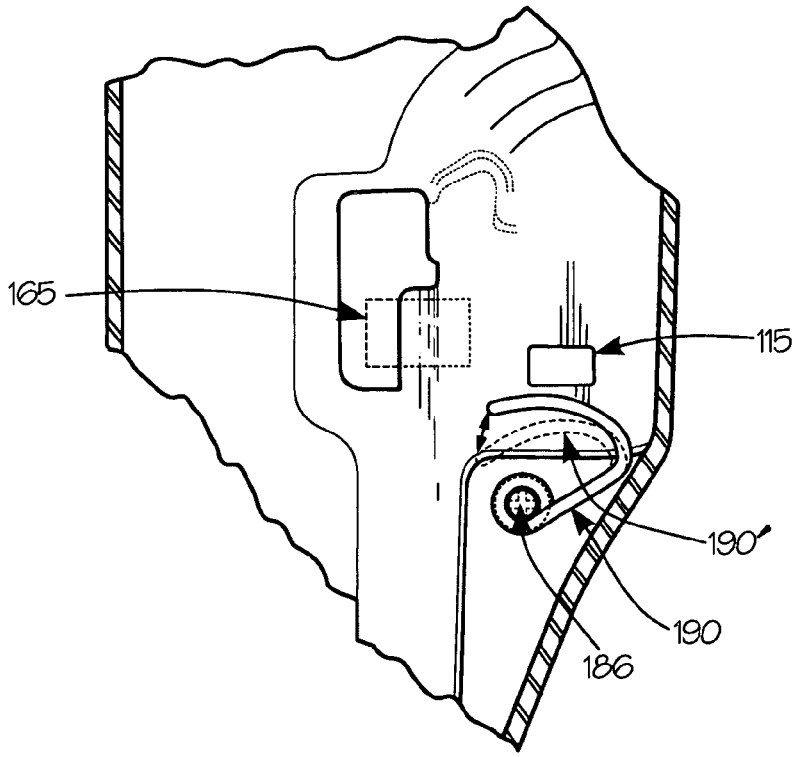
FIG. 9*b* shows a more detailed cross-sectional view taken along line B-B of the handgun holster of FIG. 5, illustrating the first exemplary embodiment of the retention system according to this invention in greater detail.

In various exemplary embodiments, the holster 100 includes attachment points 170, which provide means for fastening the holster to a holster holding device such as the holster holding device 175 illustrated in phantom in FIGS. 3 and 4. Alternatively, the means for fastening the holster may comprise a clip or hook adapted to be clipped over, for example, a belt. In further exemplary embodiments, means for fastening the holster may comprise one or more quick-disconnect or other couplings may be provided on or adjacent the second side wall 120 of the holster 100, which may be permanently or removably coupled to corresponding and cooperating coupling(s) provided on a belt or other carrier or platform. In still other exemplary embodiments, the holster 100 may comprise an integral belt, or may comprise one or more connections for attachment to a chest, ankle, leg, shoulder, or other harness or band, or for otherwise securing the holster to a user or the user's apparel.

In various exemplary embodiments, one or both of the side walls include optional slots 180 and 182, which define a passive retention portion 184. Although not shown in the present figures, the inner surface of the passive retention portion 184 may optionally include a raised area, which provides for additional frictional engagement of the trigger guard of the handgun. One or more retention screws 186 may be tightened or loosened to adjust the degree of frictional retention of the handgun by the passive retention portion 184.

The passive retention portion 184, if included, may be adjusted, via the one or more retention screws 186, to provide an adjustable frictional tension between the passive retention portion 184 and the handgun trigger guard, without increasing the frictional tension between a remaining portion of the holster 100 and the handgun.

As further shown in FIGS. 1-9B, the holster 100 comprises a retention means that is capable of retaining a handgun securely in the holster 100 by restricting withdrawal of the handgun from the cavity 105 of the holster 100 while permitting a quick release of the handgun when the user requires. The retention means comprises a lever 150, having a first side facing generally outward from the holster 100, away from the cavity 105 formed by the holster 100, and a second side facing toward the cavity 105 formed by the holster 100. The lever 150 comprises at least some of a finger button end 151 and an engagement end 155.

In various exemplary embodiments, the first side of the finger button end 151 includes a textured portion (not shown). In this manner, the finger button end 151 may be distinguished tactilely from other portions of the lever 150 or the holster 100.

In various exemplary, non-limiting embodiments, lever 150 is pivotally connected to the first side wall 110, approximately between the finger button end 151 and the engagement end 155, via a fulcrum or pivot pin 160. In various exemplary embodiments, the pivot pin 160 is positioned substantially parallel to a vertical axis of the holster 100, substantially perpendicular to a vertical axis of the holster 100, at a substantially acute angle relative to a vertical axis of the holster 100, or at a substantially obtuse angle relative to a vertical axis of the holster 100. Thus, the pivot pin 160 may be positioned at any angle relative to a vertical axis of the holster 100.

The pivot pin 160 may extend all or part of the way across the width of the lever 150.

The lever 150 is pivotable between an engaged position for securing the handgun within the cavity 105 of the holster 100 and a disengaged position for removal of the handgun. In various exemplary embodiments, the lever 150 may pivot between the engaged position and the disengaged position.

In various exemplary embodiments, the lever 150 may be biased to an engaged position whether the handgun is present in the holster 100 or absent from the holster 100. In various exemplary embodiments, biasing of the lever 150 may be accomplished by, for example, a spring means 165.

The engagement end 155 of the lever 150 includes a locking portion 156, formed on the second side of the engagement end 155. In various exemplary, nonlimiting embodiments, the locking portion 156 includes a ramp surface 157 and is shaped generally to match the contour of a portion of the inner surface of the trigger guard. Alternatively, the locking portion 156 may terminate in a radiused or not radiused manner. Particularly if the trigger guard of the handgun that is to be carried within the holster 100 is itself radiused, the ramp surface 157 may not be included.

When the lever 150 is in the engaged position, the locking portion 156 protrudes from the second side of the engagement end 155, into the cavity 105 formed in the holster 100, via an opening 115 in the first side wall 110. In this manner, the locking portion 156 may extend inside the cavity 105 and inside the trigger guard of a handgun that is placed into the holster 100 and, thereby, retain the handgun in the holster 100.

In various exemplary embodiments, the locking portion 156 protrudes into the cavity 105 for a distance that is less than the width of the trigger guard. Alternatively, the locking portion 156 may protrude into the cavity 105 for a distance that is equal to or greater than the width of the trigger guard.

In addition, when the lever 150 is in the engaged position and is retaining a handgun in place, the clearance between the locking portion 156 and the trigger guard support wall 145 should be such that there is room for the slight arc or plunger-type movement of the locking portion 156 when the finger button end 151 is depressed.

Thus, the retention means is automatically disengaged as the outer surface of the handgun's trigger guard contacts the locking portion 156 and is subsequently engaged when the inner surface of the trigger guard has passed the locking portion 156 and the handgun is appropriately retained in the holster 100.

As at least a portion of each holster 100 is formed to accommodate and securely retain a specific type of handgun. The construction of the holster 100 also prevents the locking portion 156 from contacting the trigger of the inserted handgun by limiting how far the handgun can be inserted into the holster 100.

In various exemplary embodiments, a trigger guard support wall 145 is generally formed by a portion of the body of the holster 100. The trigger guard support wall 145 is shaped generally to match the contours of at least a portion of the outer surface of the trigger guard. The trigger guard support wall 145 is formed so as to contact at least a portion of the outer surface of the trigger guard of the inserted handgun and further limit how far the handgun can be inserted into the holster 100.

The construction of the holster 100 further facilitates alignment of the trigger guard with the locking portion 156 by limiting lateral movement of the handgun with respect to the lever 150 and the locking portion 156 without preventing a user from easily holstering or drawing the handgun.

As illustrated in FIGS. 1 and 3, the holster 100 can be divided, along an axis that extends from the pivot pin 160, along the first side wall 110 of the holster 100, into a frame/slide portion and a trigger guard portion. The frame/slide portion is contoured to accept at least a portion of a frame/slide of a handgun and the trigger guard portion is contoured to accept at least a portion of a trigger guard of a handgun. Thus, it can be seen that the finger button end 151 extends into the frame/slide portion of the holster and the engagement end 155 extends into the trigger guard portion of the holster 100.

In various exemplary embodiments, an optional ridge 118 is formed in the first side wall 110 around at least a portion of the lever 150. Generally, the ridge does not contact the lever 150, but provides a perimeter around at least a portion of the lever 150 to reduce the likelihood that the lever 150 will be inadvertently manipulated and to aid in the proper placement of a user's finger on the finger button end 151 of the lever 150. The ridge 118 may include a textured portion (not shown), such that the ridge 118 may be distinguished tactilely from other portions of the holster 100 or the lever 150.

Although FIGS. 1-9B show the lever 150 connected to the first side wall 110, it should be appreciated that in various exemplary embodiments, the lever 150 may be connected to the second side wall 120.

In an illustrative, non-limiting embodiment of this invention, a biasing element 190 is optionally included. If included, the biasing element 190 extends towards the locking portion 156, covering substantially the entire distance between the trigger guard support wall 145 and the locking portion 156. In various exemplary embodiments, the biasing element 190 does not touch the locking portion 156.

It should be appreciated that any suitable spring mechanism may be used to form the biasing element 190. The overall size, shape, and thickness of the biasing element 190 will vary depending on the type and rigidity of the particular material used to form the biasing element 190.

The biasing element 190 is configured to contact the outer surface of the trigger guard and is spring-biased (as shown in phantom by 190') when the handgun is retained, or locked, in the holster. In a compressed position, the tension of the biasing element 190 biases the handgun outward and assists in maintaining contact between the locking portion 156 and the inner surface of the trigger guard.

Furthermore, the biasing element 190 may assist in removal of the handgun from the holster when the locking portion is disengaged from the trigger guard.

The biasing element 190 may be configured in a number of ways, and may be attached to the holster 100 by any suitable method. In one exemplary embodiment, the biasing element 190 is molded as an integral part of the holster 100.

During use of the holster 100 having a retention system, as a user begins to holster the handgun, the handgun is inserted into the cavity 105 of the holster, muzzle first, and is guided into position by at least some of the first side wall 110, the second side wall 120, the front wall 130, and the rear wall 140.

As the handgun is inserted further into the cavity 105, the outer surface of the trigger guard will contact the ramp surface 157 of the locking portion 156. The shape of the ramp surface 157 allows the locking portion 156 to ride along the surface of the trigger guard and displace the locking portion 156 of the lever 150. As the locking portion 156 rides along the surface of the trigger guard, the bias of the lever 150 is overcome and the lever 150 is pivoted towards the disengaged position and the handgun is permitted to be seated in the cavity 105 of the holster. The trigger guard is prevented from moving in a direction opposite the locking portion 156 by the position of the first side wall 110 and the second side wall 120.

As the handgun is further seated into the holster, the trigger guard continues to displace the locking portion 156 and the lever 150 continues to pivot until the trigger guard passes a point of contact with a farthest extent of the locking portion 156 and clears the locking portion 156. When the trigger guard passes the locking portion 156, the lever 150 may be biased, via the spring means 165, to pivot back to the engaged position.

Thus, the handgun is secured in the cavity 105 of the holster by operation of the locking portion 156 blocking removal of the handgun, via the inner surface of the trigger guard. While the handgun is fully seated in the cavity 105 of the holster 100 with the lever 150 biased to the engaged position, removal of the handgun is not permitted, as the locking portion 156 does not allow the trigger guard to pass by. When the handgun is secured in place, removal force applied to the handgun will not remove the handgun from the holster 100 unless the finger button end 151 is pivoted and the locking portion 156 is brought out of the way of the inner surface of the trigger guard.

In order to release and unholster the handgun, the user depresses the finger button end 151 of the lever 150, pivoting the finger button end 151 towards the cavity 105. At some point, the first side wall 110 will stop the inward movement of the finger button end 151, thus eliminating the possibility that the finger button end 151 can prevent the removal of the handgun by contacting the trigger or constricting the trigger guard.

As the finger button end 151 of the lever 150 is depressed, the bias of the lever 150 is overcome, the lever 150 is pivoted towards the disengaged position, and the locking portion 156 of the engagement end 155 is at least partially withdrawn from the opening 115 and out of the holster cavity 105.

When the finger button end 151 has been depressed sufficiently, such that the locking portion 156 of the engagement end 155 is sufficiently withdrawn from the holster cavity 105, such that the locking portion 156 clears the inner surface of the trigger guard, the handgun's trigger guard will no longer be blocked by the locking portion 156, and the handgun can be withdrawn from the holster 100.

In various exemplary embodiments wherein the first side wall 110 is worn away from the user's body and the second side wall 120 is worn adjacent the user's body, the finger button end 151 may be positioned such that, as the finger button end 151 is depressed, the user's index finger is positioned along the frame of the handgun, between the trigger guard and the slide. Therefore, as the handgun is withdrawn from the holster 100 the user's index finger is positioned to contact the frame of the handgun, above the trigger guard, and not the trigger guard or the trigger.

The holster 100, as shown and described with reference to FIGS. 1-9B, is oriented such that the first side wall 110 is worn away from the user's body and the second side wall 120 is worn adjacent the user's body, such that the lever 150 is generally accessible by the user's index finger. However, in various other exemplary embodiments, the first side wall 110 is oriented to be worn adjacent the user's body and the second side wall 120 is oriented to be worn away from the user's body. In these exemplary embodiments, the lever 150 is generally accessible by the user's thumb.

Figure 10A:
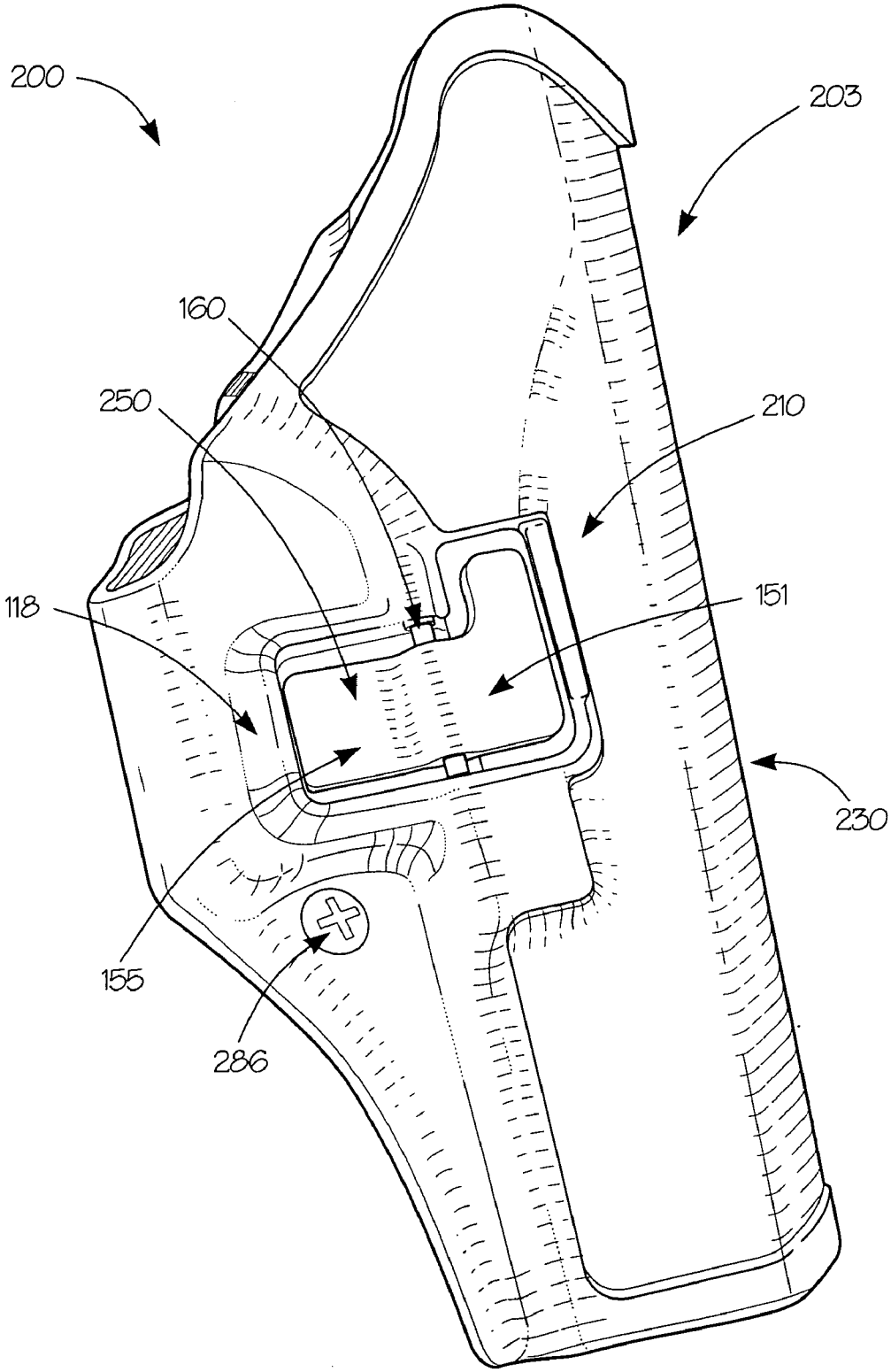
FIG. 10A shows a right perspective view of a second exemplary embodiment of a handgun holster having a retention system according to this invention.
Figure 10B:
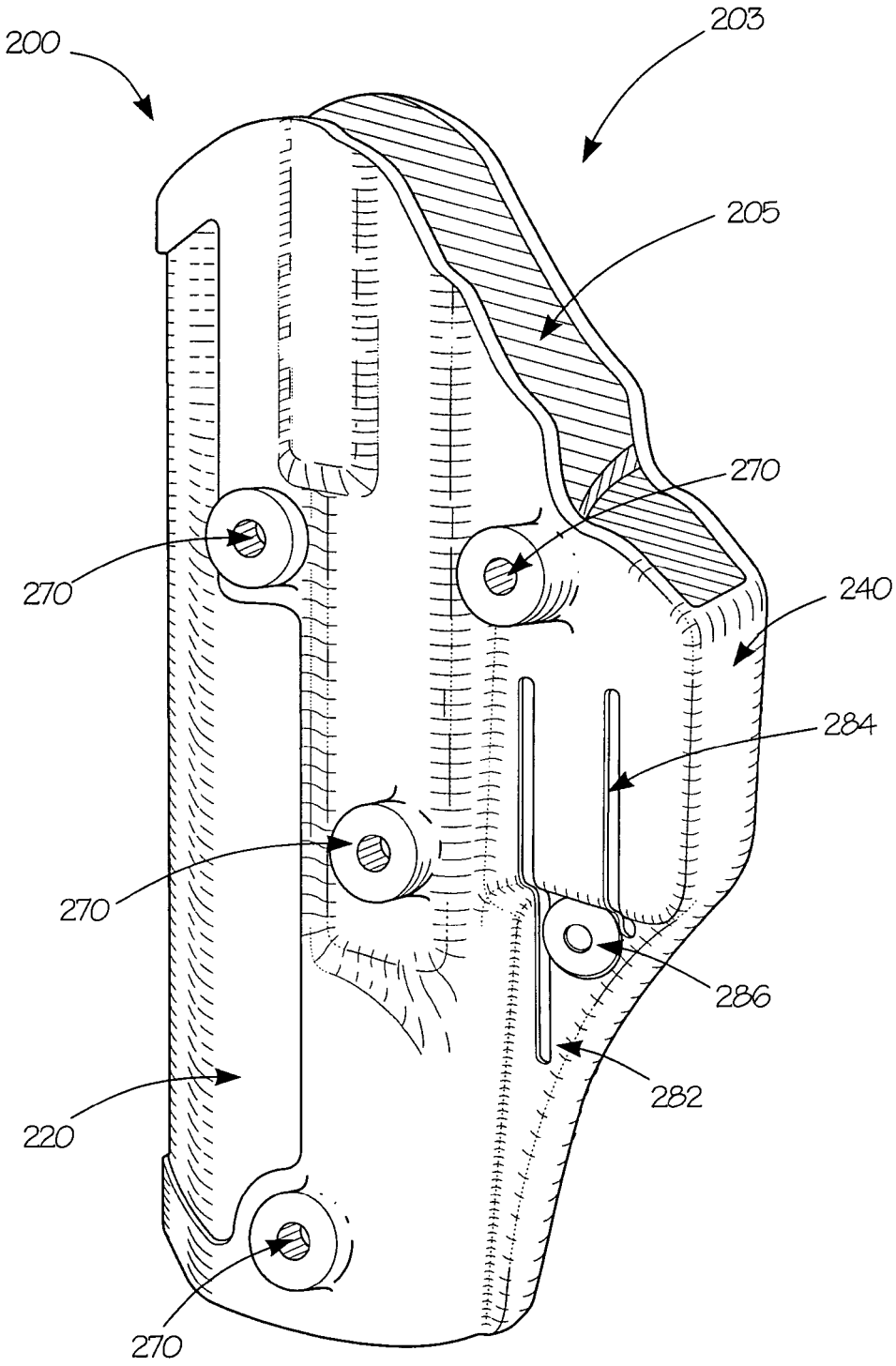
FIG. 10B shows a left perspective view of a second exemplary embodiment of a handgun holster having a retention system according to this invention.

FIGS. 10A and 10B show a right perspective view and a left perspective view, respectively, of a second exemplary embodiment of a handgun holster 200 having a retention system according to this invention. As shown in FIGS. 10A and 10B, the handgun holster 200 includes a body 203 defining a cavity 205 for receiving and holding the handgun. The body 203 comprises a pair of opposed side walls comprising a first side wall 210, a second side wall 220, a front wall 230, and a rear wall 240. The handgun holster 200 further comprises attachment points 270, optional slots 284 and 282, a passive retention screw 286, and a retention means comprising a lever 250.

It should be understood that each of these elements corresponds to and operates similarly to the body 103, the cavity 105, the first side wall 110, the second side wall 120, the front wall 130, the rear wall 140, the attachment points 170, the optional slots 180 and 182, the passive retention screw 186, the retention means, and the lever 150, as described above with reference to FIGS. 1-9B.

However, as shown in FIGS. 10A and 10B, the first side wall 210, the second side wall 220, and the front wall 230 of the handgun holster are extended, as compared to the holster 100.

The extended first side wall 210, second side wall 220, and front wall 230 perform at least three functions. First, the extended walls more fully surround and protect the handgun when the handgun is secured in the holster 200. Second, the extended walls serve to help better guide a handgun into the holster 200. Third, the extended walls serve to add a measure of strength and rigidity to the entire structure of the holster 200.

While this invention has been described in conjunction with the exemplary embodiments outlined above, it is evident that many alternatives, modifications, and variations will be apparent to those skilled in the art. Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A holster for a handgun, comprising:

a cavity having an open top end, a bottom end, a frame/slide portion, and a trigger guard portion, wherein the frame/slide portion of the cavity has greater depth than the trigger guard portion of the cavity;

an axis defined along a side wall of the holster, wherein the axis extends from the open top end to the bottom end;

a lever having a finger button portion and an engagement portion, wherein the lever includes a first side facing generally away from the holster cavity and a second side facing generally toward the holster cavity, and wherein the engagement portion of the lever includes a locking portion protruding from the second side of the engagement portion;

wherein the lever is positioned atop the side wall of the holster, and wherein the lever is pivotally attached atop the side wall of the holster, along the axis, approximately between the finger button portion and the engagement portion, such that the finger button portion extends from the axis and is situated above the frame/slide portion of the cavity and the engagement portion extends from the axis and is situated above the trigger guard portion of the cavity;

a ridge extending from the side wall around at least a portion of the lever so as to define a recess, wherein the lever is positioned within the recess; and an aperture formed in a portion of the side wall beneath at least a portion of the finger button portion of the lever, wherein the aperture is formed within the recess.

2. The holster of claim 1, wherein the frame/slide portion is contoured to accept at least a portion of a frame/slide of a handgun and the trigger guard portion is contoured to accept at least a portion of a trigger guard of a handgun.

3. The holster of claim 1, further comprising a rear wall further defining the holster cavity.

4. The holster of claim 1, wherein a first side wall is worn away from the user's body and a second side wall is worn adjacent the user's body.

5. The holster of claim 1, wherein a first side wall is worn adjacent the user's body and a second side wall is worn away from the user's body.

6. The holster of claim 1, wherein the holster is substantially rigid.

7. The holster of claim 1, wherein the holster is formed of a polymeric material.

8. The holster of claim 1, further including at least one means for fastening the holster to a holster holding device.

9. The holster of claim 1, wherein the locking portion includes a ramp surface.

10. The holster of claim 1, wherein the lever is pivotably retained in either the engaged position or the disengaged position.

11. The holster of claim 1, further including a trigger guard support wall formed in the trigger guard portion to limit the insertion of a handgun into the holster cavity.

12. The holster of claim 1, wherein when the lever is in the engaged position, the locking portion protrudes into the holster cavity, via an opening in the side wall such that the locking portion extends inside the holster cavity.

13. The holster of claim 1, wherein when the lever is in the disengaged position, the locking portion is at least partially withdrawn from the holster cavity.

14. The holster of claim 1, wherein the lever is pivotable between an engaged position and a disengaged position.

15. The holster of claim 1, wherein the lever is pivotally attached to the side wall via a pivot pin.

16. The holster of claim 15, wherein the pivot pin pivots along the axis of the holster.

17. The holster of claim 1, further comprising a front wall further defining the holster cavity.

18. The holster of claim 17, wherein the side wall and the front wall comprise a continuous wall.

19. The holster of claim 17, wherein the side wall and the front wall are coupled or joined to define the holster cavity.

20. The holster of claim 1, further comprising one or more slots, wherein the slots define a passive retention portion for providing frictional retention of the handgun by the passive retention portion.

21. The holster of claim 20, wherein one or more retention screws may be tightened or loosened to adjust the degree of frictional retention between the passive retention portion and at least a portion of the handgun.

22. The holster of claim 1, wherein the lever is biased to the engaged position.

23. The holster of claim 22, wherein the lever is biased, via a biasing means, to the engaged position.

24. The holster of claim 23, wherein the biasing means comprises a portion of spring steel, a helical spring, a compression coil spring, a cylindrical coil spring, a conical coil spring, a tension coil spring, a leaf spring, a V-spring, a cantilever spring, a spring washer, a flexible extension of the lever or the first side wall, or a stretched or tensioned material.

25. A holster for a handgun, comprising:

a cavity having an open top end, a bottom end, a frame/slide portion, and a trigger guard portion, wherein the frame/slide portion of the cavity has greater depth than the trigger guard portion of the cavity;

an axis defined along a side wall of the holster, wherein the axis extends from the open top end to the bottom end;

a lever having a finger button portion and an engagement portion, wherein the lever includes a first side facing generally away from the holster cavity and a second side facing generally toward the holster cavity, and wherein the engagement portion of the lever includes a locking portion protruding from the second side of the engagement portion;

a ridge extending from the side wall around at least a portion of the lever so as to define a recess, wherein the lever is positioned within the recess;

wherein the lever is pivotally connected, via a pivot pin that pivots along the axis, atop the sidewall of the holster, along the axis, approximately between the finger button portion and the engagement portion, such that the finger button portion extends from the axis and is situated above the frame/slide portion of the cavity and the engagement portion extends from the axis and is situated above the trigger guard portion of the cavity; and an aperture formed in a portion of the side wall beneath at least a portion of the finger button portion of the lever, wherein the aperture is formed within the recess.

26. The holster of claim 25, wherein the frame/slide portion is contoured to accept at least a portion of a frame/slide of a handgun and the trigger guard portion is contoured to accept at least a portion of a trigger guard of a handgun.

27. The holster of claim 25, wherein when the lever is in the engaged position, the locking portion protrudes into the holster cavity, via an opening in the side wall such that the locking portion extends inside the holster cavity.

28. The holster of claim 25, wherein when the lever is in the disengaged position, the locking portion is at least partially withdrawn from the holster cavity.

29. The holster of claim 25, wherein the lever is pivotable between an engaged position and a disengaged position.

30. A holster for a handgun, comprising:

a cavity having an open top end, a bottom end, a frame/slide portion, and a trigger guard portion, wherein the frame/slide portion of the cavity has greater depth than the trigger guard portion of the cavity;

an axis defined along a side wall of the holster, wherein the axis extends from the open top end to the bottom end; and a lever having a finger button portion and an engagement portion, wherein the lever includes a first side facing generally away from the holster cavity and a second side facing generally toward the holster cavity, and wherein the engagement portion of the lever includes a locking portion protruding from the second side of the engagement portion;

wherein the lever is pivotally attached to the side wall of the holster, along the axis, approximately between the finger button portion and the engagement portion, such that the finger button portion extends from the axis and is situated above the frame/slide portion of the cavity and the engagement portion extends from the axis and is situated above the trigger guard portion of the cavity;

wherein the lever is positioned atop the side wall of the holster and is pivotable between an engaged position and a disengaged position; a ridge extending from the side wall around at least a portion of the lever so as to define a recess, wherein the lever is positioned within the recess; and an aperture formed in a portion of the side wall beneath at least a portion of the finger button portion of the lever, wherein the aperture is formed within the recess; wherein, when the lever is in the engaged position, the locking portion protrudes into the holster cavity, via an opening in the side wall.

* * * * *